United States Patent [19]

Wang

[11] 4,208,577

[45] Jun. 17, 1980

[54] X-RAY TUBE HAVING SCINTILLATOR-PHOTOCATHODE SEGMENTS ALIGNED WITH PHOSPHOR SEGMENTS OF ITS DISPLAY SCREEN

[75] Inventor: Shih-Ping Wang, Los Altos, Calif.

[73] Assignee: Diagnostic Information, Inc., Sunnyvale, Calif.

[21] Appl. No.: 932,666

[22] Filed: Aug. 10, 1978

Related U.S. Application Data

[63] Continuation-in-part of Ser. No. 853,440, Nov. 21, 1977, Pat. No. 4,140,900, which is a continuation-in-part of Ser. No. 763,637, Jan. 28, 1977, abandoned.

[51] Int. Cl.[2] ..... H01J 31/50

[52] U.S. Cl. ..... 250/213 VT; 313/94

[58] Field of Search ..... 250/213 R, 213 VT, 207, 250/486, 487; 313/94, 95

[56] References Cited

U.S. PATENT DOCUMENTS

| | | | |
|---|---|---|---|
| 2,821,637 | 1/1958 | Roberts et al. | 250/213 VT |
| 2,827,571 | 3/1958 | Klasens et al. . | |
| 2,943,206 | 6/1960 | McGee et al. . | |
| 3,032,657 | 5/1962 | Meier et al. . | |
| 3,041,228 | 6/1962 | MacLeod . | |
| 3,041,456 | 6/1962 | MacLeod . | |
| 3,089,956 | 5/1963 | Harper . | |
| 3,584,216 | 6/1971 | Tinney . | |
| 3,717,764 | 2/1973 | Fujimura et al. . | |
| 3,783,298 | 1/1974 | Houston . | |
| 3,936,645 | 2/1976 | Iversen . | |
| 4,011,454 | 3/1977 | Lubowski et al. . | |
| 4,140,900 | 2/1979 | Wang | 313/94 |

*Primary Examiner*—David C. Nelms

*Attorney, Agent, or Firm*—Limbach, Limbach & Sutton

[57] ABSTRACT

An X-ray amplifier tube of the proximity design in which the scintillator screen, the photo-cathode screen and the output phosphor display screen are all segmented, with the segmentations of each screen being in registry with those of the other screens. In some embodiments one or more apertured masks are interposed between the scintillator-photocathode screen assembly and the output phosphor display screen, or ahead of the scintillator-photocathode screen assembly, the apertures of the masks being in registry with the segmentations of the scintillator-photocathode screen and the output phosphor display screen.

22 Claims, 10 Drawing Figures

X-RAY TUBE HAVING SCINTILLATOR-PHOTOCATHODE SEGMENTS ALIGNED WITH PHOSPHOR SEGMENTS OF ITS DISPLAY SCREEN

CROSS-REFERENCE TO RELATED APPLICATION

This application is a continuation-in-part of my copending patent application Ser. No. 853,440, filed Nov. 21, 1977 now U.S. Pat. No. 4,140,900, which was a continuation-in-part of my patent application Ser. No. 763,637, filed Jan. 28, 1977, entitled PANEL TYPE X-RAY INTENSIFIER TUBE, now abandoned.

BACKGROUND OF THE INVENTION

This invention relates to an X-ray sensitive amplifier tube, and more particularly to an X-ray sensitive amplifier tube for use as an array detector in computerized tomography.

In some types of X-ray computerized tomographic systems a fan-shaped X-ray beam source is moved in a predetermined pattern over a patient and a moveable or stationary X-ray detector on the opposite side of the patient detects the X-ray image which is thereby produced. The X-ray detector is actually an array of X-ray detectors for detecting the fan-shaped beam at discrete intervals. The cost of manufacturing this array of detectors is quite large in a conventional system. It is also difficult to align the detectors properly and they often have dissimilar gain characteristics, making operational adjustments to the system difficult. Still another disadvantage of some prior art systems is that the thickness of the scintillation screens in the X-ray detectors are limited by spacial resolution requirements. This can limit the sensitivity of the system or else require a higher X-ray dosage which is undesirable for the patient. Still a further problem of the X-ray detectors in such systems is that because of the low light level produced at the output screen additional relatively expensive, high gain light detectors are required.

A suitable X-ray amplifier-detector tube which overcomes many of the manufacturing cost and alignment problems is an X-ray amplifier tube of the proximity type design, such as that disclosed in the applicant's previous application, Ser. No. 741,430, referred to above. Such a tube of the type disclosed in that patent application is not quite as suitable without modification, however, as an array detector. Before such a tube can be used as an array detector it must be segmented to produce an array of amplifying elements which have minimum influence upon or cross-talk with other members of the array. This is extremely essential in applications for computerized tomography since each detector in the array must have maximum independence to give a subsequent image reconstruction with minimum corrections and a high resolution.

There are four main sources of cross-talk in a proximity type, X-ray image array, intensifier tube:

(a) cross-talk due to light spreading in the scintillator screen, (b) cross-talk due to light from the scintillation screen which passes through the photocathode and is reflected back to it by the output screen, (c) cross-talk due to reflections of (or back scattering of) photoelectrons by the output screen, and (d) cross-talk due to light spreading in the output screen.

(e) cross-talk due to the feedback of X-ray bremsstrahlung and ions produced at the output screen by the bombarding of photo-electrons.

SUMMARY OF THE INVENTION

The above disadvantages of prior art X-ray image detectors and amplifiers are overcome by the applicant's modifications of his proximity type image intensifier tube. The first major modification is to segment the scintillator-photocathode screen assembly which is interposed between the input window and the output display screen within an evacuated tube envelope. The segmented assembly thus presents an array of discrete islands to the impinging X-ray image. Furthermore, the output phosphor display screen is also segmented and its segmentations are in registry with the segmentations of the scintillator-photocathode screen assembly.

In a further possible modification, a first apertured mask within the tube envelope is interposed between the segmented scintillator-photocathode screen assembly and the segmented output phosphor display screen. The apertures of the first mask are in registry with the segmentations of the output phosphor display screen. The first mask is maintained at the same electrostatic potential as the output phosphor display screen for convenience of manufacture. In another possible modification, a second apertured mask within the tube envelope is interposed between the segmented scintillator-photocathode screen and the first mask. The apertures of the second mask are in registry with the segmentations of the scintillator-photocathode screen assembly. The second mask is maintained at the same electrostatic potential as the scintillator-photocathode screen assembly for convenience of manufacture.

In still another possible modification, each of the scintillator-photocathode assembly segmentations is convexoconcave with respect to input primary X-rays passing through the input window of the tube. In a still further possible modification, an input apertured mask within the tube envelope is interposed between the scintillator screen and the input window. The apertures of the input mask are in registry with the segmentations of the scintillator screen.

The purposes of all these modifications are to reduce cross-talk in one of the catagories listed above, as will be explained in greater detail herein. The modifications of the various masks and contouring of the segmentations can be used in various combinations or all together with the basic modification.

In operation, the segmentations of the scintillator-photocathode screen assembly break-up the X-ray image into discrete sections which are detected and converted into an array of photoelectron point patterns. The configuration of the segmentations reduce light spreading from one segmentation to another and the selectively deposited photocathode minimizes spurious photoelectron emission. The masks in between the output display screen and the scintillator-photocathode assembly reduce feedback of bremsstrahlung and ions and reflection or backscattering of the photoelectrons. The first mask blocks reflective photoelectrons from the output phosphor display screen and prevents them from reaching other segmentations of the display screen which would result in cross-talk. The apertured mask can also be made blackened so that scintillation light transmitted through the photocathode can be absorbed by the mask. The mask will also reduce the light escape generated by the output screen segmentations to the photocathode. The mask may be made of a very high atomic number alloy to absorb primary X-ray scatter inside the tube and to reduce the scatter of X-ray bremsstrahlung generated by the photoelectrons at the output screen.

The second apertured mask creates some focusing action to the photoelectrons and thereby compensates for the slight defocusing action of the first apertured mask. The third mask, that is the mask which is between the input window and scintillator photocathode screen, absorbs the scattered primary X-rays before they reach the scintillator-photocathode screen assembly.

The entire tube of the invention can be made either flat (planar) or curved, depending on the distance between the X-ray source and the tube. The flat version is useful in applications where the X-ray source is relatively distant from the tube and generates a well collimated beam. The curved version is useful in applications where the X-ray source is relatively close to the tube. In the latter application, several curved tubes may be placed along an arc with very efficient packing. This arrangement has several advantages over discrete scintillator-photomultiplier detectors. First, the cost of manufacturing a large array of detectors is lower with the invention. Second, the alignment is relatively simple compared to prior art systems. Third, with the system of the invention it is easier to obtain an array of detectors with similar gain characteristics than in such prior art systems.

Because the scintillator thickness of the system of the invention is less restricted by spacial resolution requirements, the scintillator thickness may be greater than in prior art systems and can be over 200 microns. The materials for the scintillator can be CsI(Tl), CsI(Na), NaI(Tl) and other materials like $CaWO_4$, TlCl, BGO (or $Bi_4Ge_3O_{12}$), etc. which possess high X-ray stopping power, reasonable scintillation efficiency, reasonable response time and persistence.

The signal provided in each segmentation or island in the output phosphor display screen is picked up by an array of light sensitive detectors. This light intensity is between 100 and 1,000 times higher than the light intensity that can be provided by a typical NaI(Tl) scintillator or fluoroscopic screen. Therefore, much less expensive light sensing devices can be used than the photomultiplifer tubes used with some prior art systems. In the preferred embodiment of the present invention, the array of photodetectors is positioned adjacent the output display screen, with each photodetector of the array being aligned with a separate segmentation of the output phosphor display screen and output window.

It is therefore an object of the present invention to provide a large area, X-ray sensitive, array amplifier tube of the proximity design which has low cross-talk.

It is another object of the invention to provide a large area, X-ray sensitive, array amplifier tube which is relatively inexpensive to manufacture compared to conventional systems.

It is still a further object of the invention to provide a large area, X-ray sensitive, array amplifier which is easily aligned and which has similar gain characteristics for the separate segments of the amplifier.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENTS AND OTHER EMBODIMENTS

Figure 1:
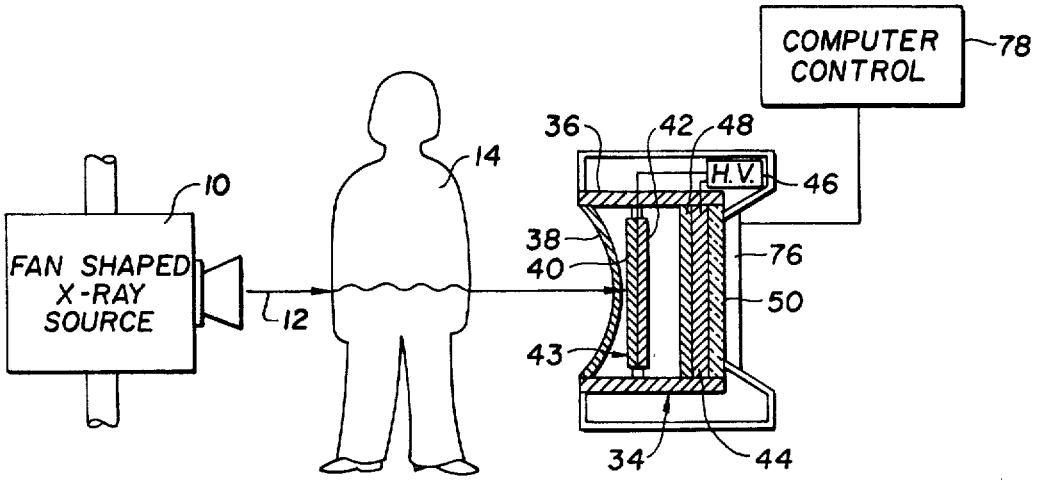
FIG. 1 is a diagrammatic view of the X-ray amplifier tube of the invention as used in a typical computerized axial tomographic system.

Referring now more particularly to FIG. 1, a large area, panel shaped proximity type X-ray image array amplifier tube according to the invention is illustrated. The reference numerals utilized in this description correspond, as closely as possible, to the reference numerals used in the applicant's prior application referred to above. The tube 34 comprises a metallic, typically type 304 stainless steel, vacuum tube envelope 36 and a metallic, inwardly concave input window 38. The window 38 is made of a specially chosen metal foil or alloy metal foil in the family of iron, chromium, and nickel, and in some embodiments, additionally combinations of iron or nickel together with cobalt of vanadium. It is important to note that these elements are not customarily recognized in the field as a good X-ray window material in the diagnostic region of the X-ray spectrum. By making the window thin, down to 0.1 mm in thickness, the applicant was able to achieve high X-ray transmission with these materials and at the same time obtain the desired tensile strength. In particular, a foil made of 17-7 PH type of precipitation hardened chromium-nickel stainless steel is utilized in the preferred embodiment. This alloy is vacuum tight, high in tensile strength and has very attractive X-ray properties: high transmission to primary X-rays, low self-scattering, and reasonably absorbing with respect to patient scattered X-rays. The window 38 is concave into the tube like a drum head.

The use of materials which are known for high X-ray transmission such as beryllium, aluminum and titanium for example cause the undesirable scattering which is present in some prior art proximity type, X-ray image intensifier devices.

One purpose of having a metallic window 38 is that it can be quite large in diameter with respect to the prior art type of convex, glass windows without affecting the X-ray image quality. In one embodiment, the window measures 0.1 mm thick, 25 mm by 25 cm and withstood over 100 pounds per square inch of pressure. The input window can be square, rectangular, or circular in shape, since it is a high tensile strength material and is under tension rather than compression.

The X-ray image passing through the window 38 impinges upon a flat, segmented scintillation screen 40 which converts the X-ray image into a light image. This light image is contact transformed directly to an immediately adjacent, segmented, flat photocathode screen 42 which converts the light image into a pattern of electrons.

As will be explained in greater detail with reference to FIGS. 3-9, the segmentations of the scintillation screen 40 are in registry with the segmentations of the photocathode screen 42 to act as part of an array of the image intensifying elements. The scintillator and photocathode screens 40 and 42 comprise a complete, segmented assembly 43.

The electron pattern on the segmented, negatively charged screen 42 is accelerated towards a positively charged, segmented flat phosphor output display screen 44 by means of an electrostatic potential supplied by a high voltage source 46 connected between the segmented output screen 44 and the segmented, photocathode screen 42. Although the display screen 44 is positive with respect to the scintillator-photocathode screen assembly 43, it is at a neutral potential with respect to the remaining elements of the tube, including the metallic envelope 36, to thereby reduce distortion due to field emission. No microchannel plate is interposed between the output phosphor screen and the photocathode screen as is done in some prior embodiments. The use of such a non-linear device (with respect to input X-ray dosage) causes distortion in and of itself but it also increases the deleterious field emission effects since some of the elements of the microchannel plate must operate at different electrostatic potentials with respect to the output display screen and thereby become sources for spurious electron emission.

It should be noted that no substantial focusing takes place in the tube 34 as opposed to the prior art types of image intensifier tubes of the kind which have focusing grids. The screen 40, the photocathode layer 42 and the display screen 44 are parallel to each other. Also, the gap spacing between the photocathode 42 and the display screen 44 is relatively long, in the range of 8 to 25 millimeters, thereby reducing the likelihood of field emission and at the same time keeping the electrostatic defocusing to a tolerable level, that is, aroung 2.0 to 3.0 line pairs per millimeter.

Furthermore, the applied voltage across the gap between photocathode layer 42 and the display screen 44 is in the range of 20,000 to 60,000 volts (20 to 60 Kv). In the preferred embodiments of the invention, the spacing between the photocathode screen 42 and the output display screen 44 is between 8 mm (at 20 Kv) and 25 mm (at 60 Kv). Thus, the voltage per unit of distance, i.e., the field strength, is at least 2 Kv/mm. An upper limit to the field strength is about 5 Kv/mm.

In prior art devices such a high field strength was not considered feasible for this application of an image intensifier device because of the field emission problems discussed above and which are obviated in the applicant's device by having all of the tube elements, save for the photocathode-scintillator screen assembly, be at a neutral potential with respect to the output display screen.

The overall thickness of the scintillator screen 40 is chosen to be at least 200 microns thick to give a higher X-ray photon utilization ability than prior art devices, thereby allowing overall lower patient X-ray dosage levels without a noticeable loss of quality as compared to prior art devices. The scintillator screen 40 can be made of vapor deposited CsI(Na), or calcium tungstate ($CaWO_4$) or pieces of single crystals of BGO ($Bi_4Ge_3O_{12}$) or NaI(Tl). This is because the format of the tube and the high gain produced by the high field strength give an extra margin of sharpness to the image which can be traded off in favor of lower patient dosage levels with greater X-ray stopping power at the scintillator screen 40.

The segmented phosphor layer constituting the screen 44 is deposited on an optically segmented high Z glass output window 50. By high Z is meant that the window glass has a high concentration of barium or lead to reduce X-ray black scatter inside and outside the tube and to shield the radiologist from both primary and scattered radiation. In contrast to prior art X-ray image intensifier tubes whose output phosphor screen thickness is limited by considerations of resolution and tube voltage to a thickness of about 1.0 mg/cm$^2$, the screen 44 of the present invention is much thicker, on the order of 2 to 4 mg/cm$^2$. Since the combined, segmented display in the present invention is full sized, resolution is much less of a problem and the higher tube voltage produces an electron velocity from the photocathode which is more effectively stopped by the thicker screen. This also increases the light output of the display segments to give greater brightness gain.

The segmented output phosphor screen 44 can be of the well known zinc-cadium sulfide type (ZnCdS(Ag)) or zinc sulfide type (ZnS(AG)) or a rare earth material like yttrium oxysulfide type ($Y_2O_2S$(TB)) or any other suitable high efficiency blue and/or green emitting phosphor material. The interiorly facing surface of the output screen is covered with a metallic aluminum film 48 as will be explained in greater detail in reference to FIGS. 2, 3 and 4.

The thick, high atomic number (Z), segmented glass substrate 50 on which the segmented phosphor display screen 44 is deposited forms one exterior end wall of the vacuum tube envelope 36. This segmented glass substrate 50 is attached to the tube envelope 36 by means of a collar 54 made of an iron, nickel, chromium alloy, designated to the trade as "Carpenter, No. 456." Since the thermal coefficient of expansion of this alloy matches that of the glass and nearly matches that of the tube envelope 36, the collar 54 can be fritted to the glass substrate 50 and welded to the tube enveloe 36.

The essentially all metallic and rugged construction of the tube minimizes the danger of implosion. The small vacuum space enclosed by the tube represents much smaller stored potential energy as compared with a conventional tube which further minimizes implosion danger. Furthermore, if punctured, the metal behaves differently from glass and the air simply leaks in without fracturing or imploding.

The photocurrent drawn by the tube from the power supply 46 is dependent, of course, on the image surface area of the scintillator-photocathode screen assembly 43 and the output display screen 44. For a tube used for direct viewing, the photocurrent would be 0.4 to $0.8\times10^{-9}$ amperes/cm$^2$ at an X-ray dosage level of 1 mR/sec.

Figure 2:
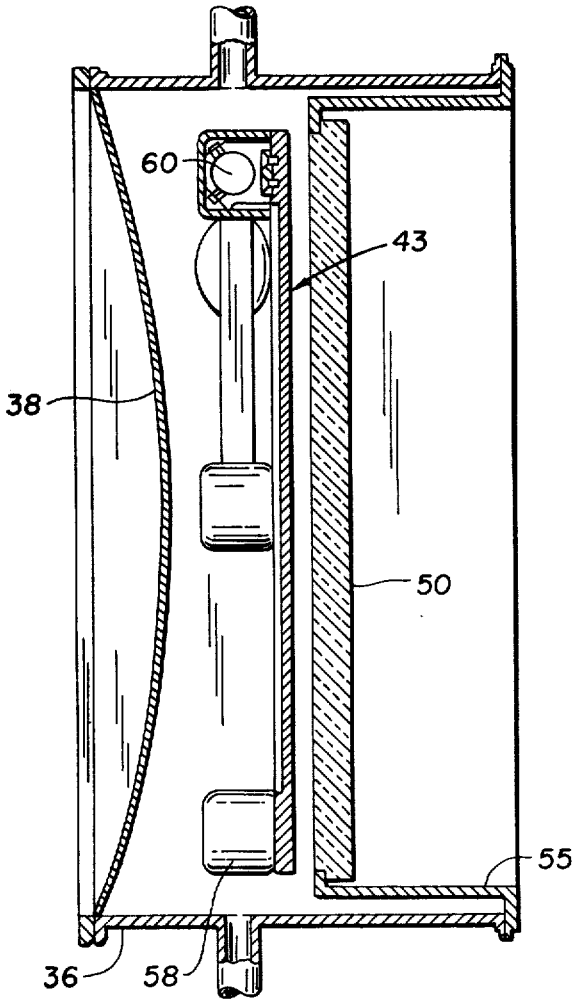
FIG. 2 is a vertical, sectional view, with portions broken away of the X-ray amplifier tube according to the invention.
Figure 3:
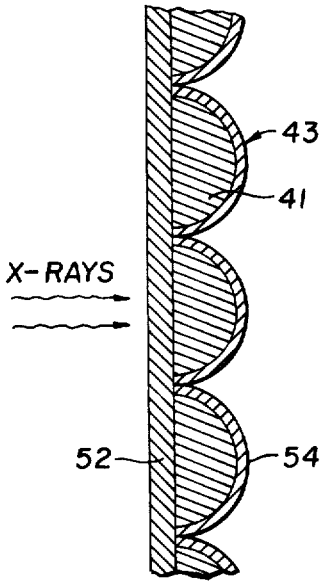
FIG. 3 is an enlarged, vertical view, of a portion of the scintillator-photocathode screen assembly of the amplifier tube according to the invention.
Figure 4:
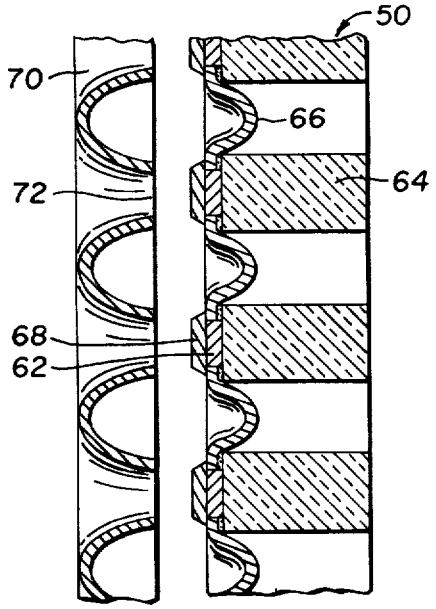
FIG. 4 is an enlarged, vertical, sectional view of the output phosphor display screen of a second embodiment of the invention.

Referring now more particularly to FIGS. 2, 3 and 4, in a cross-sectional view, the details of the segmented scintillation and photocathode screen assembly 43 and the segmented output display screen assembly 44 will now be described.

While the usual use of an X-ray image intensifier tube is to amplify a single X-ray image it is sometimes desirable to simultaneously amplify and then detect a group of X-ray image points. When this is done in conjunction with computerized tomography it is essential that each X-ray image point be detected and amplified independently of the other points so that the subsequent image reconstruction can be made by the computer with minimum corrections and a high resolution. This requirement of highly independent detection of the image points necessitates that there be a minimum of cross-talk between the amplifying and detecting elements for the various image points. The purpose of the segmentations in the photocathode screen assembly 43, the output display screen 44 and the window 50 are to both provide for separate amplification of the array of image points and to reduce such cross-talk.

The screen assembly 43 comprises a segmented scintillator 40 of very smooth calcium tungstate or sodium activated cesium iodide which is vapor deposited as an array of discrete islands or segments 41 on a smoothly polished nickel plated aluminum planar substrate or an anodized aluminum planar substrate 52 on a side of the substrate which faces away from the input window 38. The techniques of such vapor deposition processes are known to those skilled in the art, see for example, U.S. Pat. No. 3,825,763. The segmentation can be achieved, for example, by evaporation through a suitably apertured mask. The segments 41 are between 200 to 600 microns thick. The spacing between the segmentations is dependent on the degree of detail desired in the detected and amplified X-ray image. The spacing can be on the order of 50 to 150 microns.

As mentioned above, the purpose of the segmented scintillator screen 40 is to convert the X-ray image into a segmented light image. Photocathode segments 54 are deposited on top of the scintillation segment surfaces 41 which face away from the substrate 52. The photocathode segments 54 convert the light image array from the scintillator segments 41 into an electron pattern array of image points. The array of free electrons from the photocathode segments 54 are accelerated by means of the high voltage potential 46 toward the segmented display screen 44, all as mentioned above. The photocathode segments 54 are also of a material well known to those skilled in the art, being cesium and antimony ($Cs_3Sb$) or multi-alkali metal (combinations of cesium, potassium and sodium) and antimony.

The scintillator-photocathode screen assembly 43 in this invention is suspended from the tube envelope 36 between the input window 38 and the output screen 44 by several insulating posts 58. One or more of these posts may be hollow in the center to allow an insulated high voltage cable 60 from the source 46 to be inserted to provide the scintillator photocathode screen assembly 43 at the substrate 52 with a negative high potential. This concept of minimizing the surface area which is negative with respect to the output screen results in a reduced field emission rate inside the tube and allows the tube to be operable at higher voltages and thus higher brightness gain. It also minimizes the danger of electrical shock to the patient or workers if one should somehow come in contact with the exterior envelope of the tube.

To reduce charges accumulated on the insulating posts 58, they are coated with a slightly conductive material such as chrome oxide which bleeds off the accumulated charge by providing a leakage path of better than 20 Kv/cm.

The output phosphor display screen 44 is actually made of an array of discrete islands 62 of phosphor deposited on separate, optically isolated output windows 64 or on a fiber optical plate. The positions of the discrete islands 62 are in registry with the segmentations 41 and 54 of the scintillator-photocathode screen assembly 43. The glass windows 64 are joined to an apertured metal support screen 66 so that spaces are left between the windows 64 which may be filled with either a reflecting medium or a medium having a lower refractive index than the windows 64 so that total internal reflection takes place within the windows 64 at their longitudinal surfaces. The glass is joined to the metal support 66 by frit or other glass-metal sealing means.

The phosphor islands 62 are then covered with discrete layers of aluminum film 68 by standard methods such as by vapor deposition through a suitably apertured mask. The aluminum film makes contact with the metallic screen 66 to provide an electrical connection to the tube envelope through the screen 66. The film islands 68 also increase the light output of the phosphor islands and reduce light feedback of the output light to the scintillator-photocathode screen assembly 43.

Figure 5:
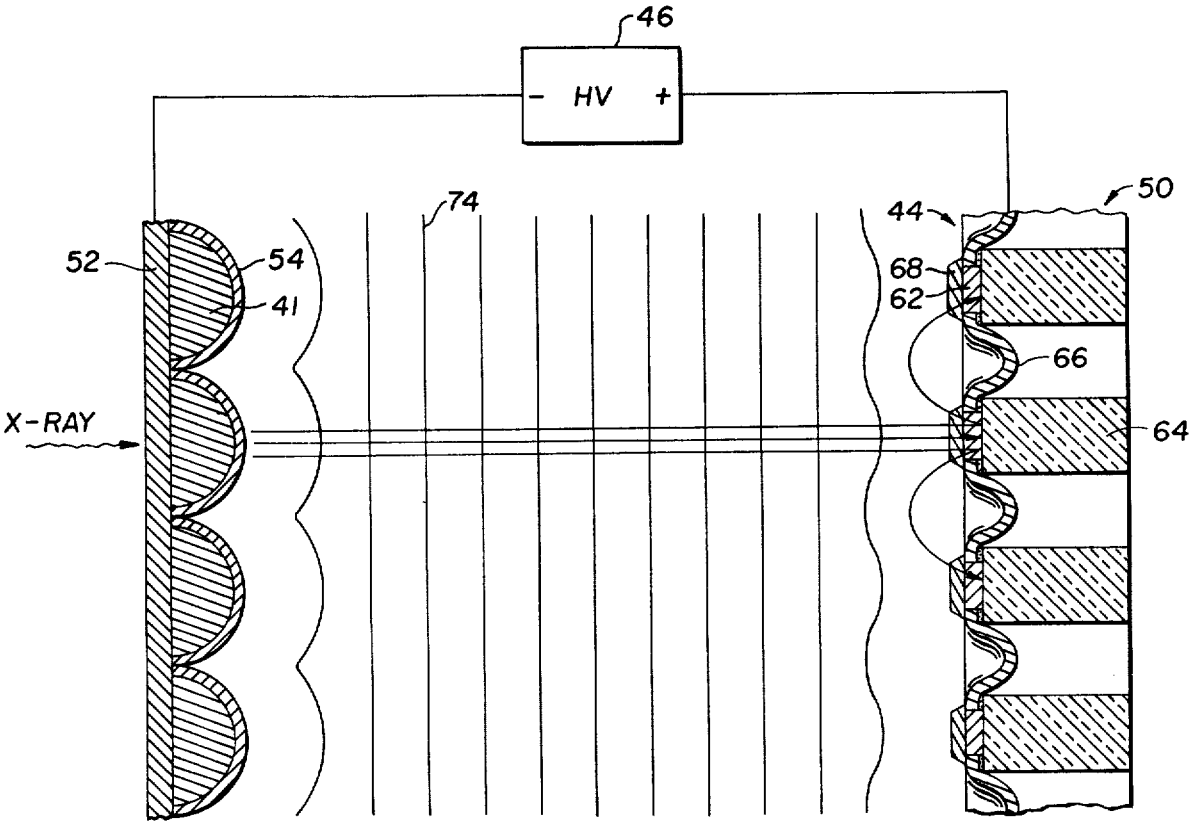
FIG. 5 is an enlarged, vertical, sectional view of the scintillator-photocathode screen assembly together with the output phosphor display screen assembly of the preferred embodiment of the invention, with portions broken away and diagrammatically illustrating the lines of electrostatic potential.
Figure 6:
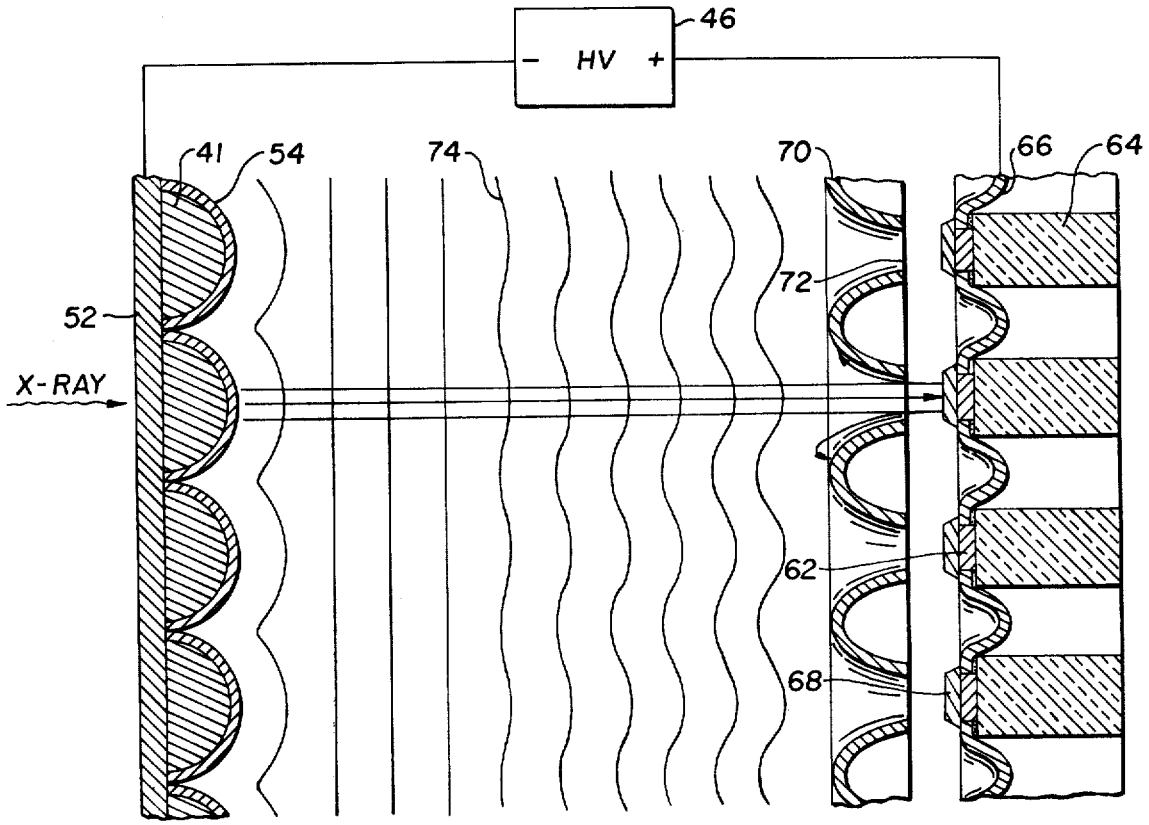
FIG. 6 is an enlarged, vertical, sectional view of the scintillator-photocathode screen assembly and output phosphor display screen of the second embodiment of the invention with a diagrammatic illustration of the lines of electrostatic potential.

A first mask 70 is positioned between the scintillator-photocathode screen assembly 43 and the output screen assembly 44 to reduce reflection or backscattering of the photoelectrons. The mask is provided with apertures 72 which are aligned with the scintillator-photocathode assembly islands 41 and 54, respectively, and the output phosphor display screen islands 62. In this way, the photoelectrons from the photocathode islands 54 can travel from the photocathode, through the apertures 72 and land only on the output screen islands 62. As best shown in FIGS. 5 and 6, reflected photoelectrons from the islands 62 are blocked by the aperture walls of the screen 70 and are prevented from reaching other output screen islands. The restricted angles through which the reflected photoelectrons can escape the apertured mask are so small that the probability is high for the escaped photoelectrons to be turned back onto the same output screen island 62 by the electrical field between the scintillator-photocathode screen assembly 43 and the mask 70. The mask is operated at the anode potential, that is the potential of the output phosphor display screen assembly 44, for the sake of simplicity. In other embodiments, however, it can be operated at potentials other than those of the anode potential.

The electrical field equipotential lines 74 in the FIGS. 5 and 6, illustrate the electrostatic forces acting on the photoelectrons in the case without the apertured mask 70 and the case with the apertured mask 70. The mask 70 can also be made blackened so that scintillation light transmitted through the photocathode islands 54 will be absorbed by the mask. The mask 70 will also reduce the escape of light from one output screen island 62 to photocathode islands 54 which are not in registry with it.

On the exterior surface of the output display screen window 50 are provided, at each isolated output window, a separate light sensitive detector. The light intensity of the signal provided at the discrete output windows is between 100 to 1,000 times higher than the light intensity that is provided by a NaI(Tl) scintillator or fluroscopic screen. Therefore, much less expensive light sensing devices can be used than conventional photomultiplier tubes. In practice, an array of photo-optical devices 76 (FIG. 1) are attached to the exterior surface at the output display window 50. This array of photo-optic devices is aligned with the output windows so that each element in the array is associated with a spearate window to provide a plurality of signals to a computer control network 78. The computer control network 78 analyzes the signals in a conventional manner for computerized, tomographic systems.

Figure 7:
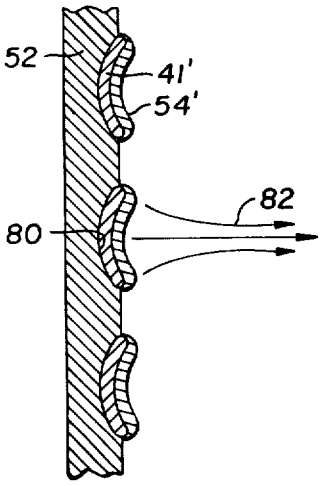
FIG. 7 is an enlarged, vertical, sectional view of the scintillator-photocathode screen assembly of a third embodiment of the invention.

Referring now more particularly to FIG. 7, in another embodiment of the invention, the side of the substrate 52 which faces away from the input window 38 is provided with an array of indentations 80 into which are deposited scintillator islands 41'. Photocathode islands 54' are deposited over the scintillator islands 41'. The indentations 80 are shaped such that the islands 41' and 54' have a convexo-concave cross-sectional shape with respect to the input primary X-rays passing through the input window 38. As is illustrated in FIG. 7, this shape provides a slight focusing action to the photoelectrons 82 generated at the island 54' and compensates for some of the defocusing action generated by the apertured mask 70.

Figure 8:
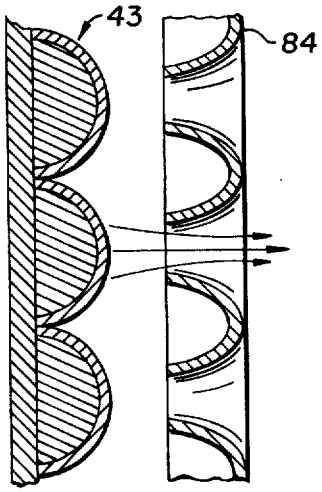
FIG. 8 is an enlarged, vertical, sectional view of the scintillator-photocathode screen assembly of a fourth embodiment of the invention; and, FIG. 9 is an enlarged, vertical, sectional view of a modification of the output phosphor display screen of the X-ray amplifier tube of the preferred embodiment of the invention.

Referring now more particularly to FIG. 8, in another embodiment of the invention a second apertured mask 84 is positioned on the output screen side of the scintillator-photocathode screen assembly 43. The screen 84 is positioned closely adjacent to the scintillator-photocathode screen assembly 43 to create some focusing action in respect to the photoelectrons escaping from the phtotcathode 42 and to compensate for the slight defocusing action of the apertured screen 70. The focusing action provided by the screen 84 is similar to the focusing action provided by the modified geometry of the embodiment depicted in FIG. 7 and described immediately above. For the sake of simplicity, the mask 84 is operated at the same electrical potential as the scintillator-photocathode screen assembly 43 and is mounted along with it on the insulating posts 58. In both of the embodiments of FIGS. 6 and 8, the apertured masks 70 and 84 can be made of a very high atomic number alloy to absorb the primary X-ray scatter inside of the tube and to reduce the scatter of X-ray Bremsstrahlung generated by the photoelectrons at the output screen 44.

Figure 9:
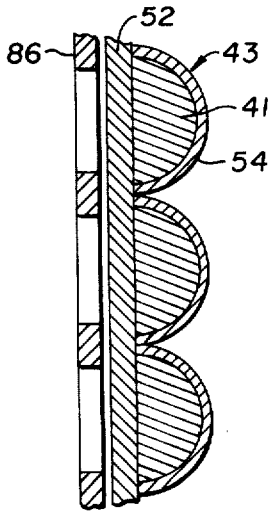

Referring now more particularly to FIG. 9, still another modification which may be made to any of the foregoing embodiments, is the addition of still a third apertured mask 86 on the X-ray side of the scintillator-photocathode screen assembly 43. The mask 86 absorbs scattered primary X-rays before letting them reach the scintillator screen islands 41.

Figure 10:
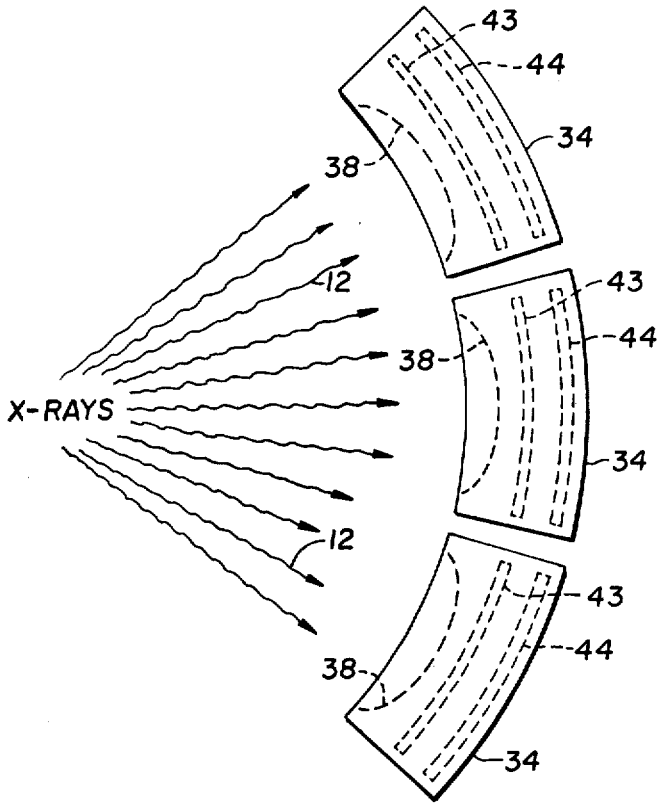
FIG. 10 is a diagrammatic view of a further embodiment of the invention.

The entire tube of the invention can be constructed to have either a flat or a curved external and internal geometry. In the flat version, as depicted in the foregoing figures, the scintillator-photocathode screen assembly 43 and the output display screen 44 are planar. In the curved version, as depicted in FIG. 10, the tube walls can be made parallel to the direction of travel of the X-ray beam and the scintillator-photocathode screen assembly 43 and the output display screen 44 may be made similarly curved about hypothetical circumferences at predetermined radiuses from the X-ray source. The planar version is very suitable for a well collimated beam of X-rays as in the case where the source is far away.

In the curved version of the invention, several tubes 34 may be placed along an arc with respect to the source of X-rays for efficient packing. This arrangement has several advantages over discrete scintillator-photomultiplier detectors of the conventional design. In the first place, the cost of manufacturing a large array of detectors with the applicant's invention is lower. Secondly, the problems of alignment are greatly simplified. Thirdly, it is easier to obtain an array of detectors with similar gain characteristics utilizing the tube of the invention.

It is also possible to add an additional stage of amplification to the detector array to provide additional gain and to allow wider selection of photo detectors to be used. This additional stage of amplification consists of an additional electrode operating at an intermediate voltage between the voltages applied to the scintillator screen and the output screen. This additional electrode is placed between the scintillator screen and the output screen and includes an array of segmented glass on a metal substrate or a plate of fiber optics with the photocathode coated on one side and a phosphor screen coated on the other. A more detailed description of this type of additional stage of amplification is given in the applicant's co-pending application Ser. No. 885,169, filed Mar. 10, 1978, entitled GAMMA RAY CAMERA.

In this embodiment, additional sets of aperture masks are also added; that is, a set of aperture masks of the type described above are added in the space between the scintillator screen and this electrode and a similar set of aperture masks are also added in the space between this electrode and the output screen so that a cascade of scintillator-photocathode-phosphor screens is made.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. A large area, X-ray array amplifier-detector tube comprising:

a tube envelope open at both ends, an input window at one end of the envelope for receiving input primary X-rays, a segmented output phosphor display screen at the other end of the envelope, a segmented scintillator-photocathode screen assembly interposed between the input window and the output display screen, the segmentations of the scintillator-photocathode screen assembly being in registration with the segmentations of the output phosphor display screen, and means for applying a high electostatic potential between the scintillator-photocathode screen assembly and the output display screen.

2. A large area, X-ray array amplifier-detector tube as recited in claim 1 further comprising a first apertured mask within the tube envelope and interposed between the scintillator-photocathode screen assembly and the output phosphor display screen, the apertures of the first mask being in registry with the segmentations of the output phosphor display screen.

3. A large area, X-ray array amplifier-detector tube as recited in claim 2 wherein the electrostatic potential means apply to the first mask the same electrostatic potential as is applied to the output phosphor display screen.

4. A large area, X-ray array amplifier-detector tube as recited in claim 2 further comprising a second apertured mask within the tube envelope and interposed between the scintillator-photocathode screen and the first mask, the apertures of the second mask being in registry with the segmentations of the scintillator-photocathode screen assembly.

5. A large area, X-ray array amplifier-detector tube as recited in claim 4 wherein the electrostatic potential means apply to the second mask the same electrostatic potential as is applied to the scintillator-photocathode screen assembly.

6. A large area, X-ray array amplifier-detector tube as recited in claim 2 wherein each of the scintillator segmentations is convexo-concave with respect to input primary X-rays passing through the input window.

7. A large area, X-ray array amplifier-detector tube as recited in claim 1 further comprising an input apertured mask within the tube envelope and interposed between the scintillator screen and the input window and wherein the apertures of the input mask are in registry with the segmentations of the scintillator screen.

8. A large area, X-ray array amplifier-detector tube as recited in claim 1 further comprising an array of photodetectors positioned adjacent the output display screen, each photodetector of the array being aligned with a separate segmentation of the output phosphor display screen.

9. A large area, X-ray array amplifier-detector tube as recited in claim 1, wherein the output phosphor display screen comprises a transversely segmented high Z glass window in the other end of the tube envelope and a phosphor layer on the surface of the window which is interior with respect to the tube envelope.

10. A large area, X-ray array amplifier-detector tube as recited in claim 9, wherein the tube envelope is metallic and includes a collar of iron-nickel alloy which is fritted to the output window and welded to the tube envelope for mounting the output window in the other end of the tube envelope.

11. A large area, X-ray array amplifier-detector tube as recited in claim 1, wherein the scintillator screen includes a vapor deposited, segmented layer of sodium activated, cesium iodide (CsI(Na)).

12. A large area, X-ray array amplifier-detector tube as recited in claim 11, wherein the segmented CsI(Na) layer is between 200 and 600$\mu$ thick.

13. A large area, X-ray array amplifier-detector tube as recited in claim 1, wherein the scintillator screen includes a vapor deposited, segmented layer of calcium tungstate ($CaWO_4$).

14. A large area, X-ray array amplifier-detector tube as recited in claim 1, wherein the scintillator screen includes pieces of single crystals of bismuth germanate (BGO[$Bi_4Ge_3O_{12}$]).

15. A large area, X-ray array amplifier-detector tube as recited in claim 1, wherein the scintillator screen includes thallium activated sodium iodide (NaI[Tl]).

16. A large area, X-ray array amplifier-detector tube as recited in claim 1, wherein the input window is made of 17-7 PH type of precipitation hardened, chromium-nickel stainless steel.

17. A large area, X-ray array amplifier-detector tube comprising:

a tube envelope open at both ends, an input window at one end of the envelope for receiving input primary X-rays, a segmented output phosphor display screen at the other end of the envelope, a plurality of segmented scintillator-photocathode screen assemblies interposed between the input window and the output display screen, the segmentations of each scintillator-photocathode screen assembly being in registration with the segmentations of the output phosphor display screen, and means for applying different high electrostatic potentials between the scintillator-photocathode screen assemblies and the output display screen.

18. A large area, X-ray array amplifier detector tube as recited in claim 17, further comprising a first apertured mask within the tube envelope and interposed between one of the scintillator-photocathode screen assemblies and the output phosphor display screen, the apertures of the first mask being in registry with the segmentations of the output phosphor display screen.

19. A large area, X-ray array amplifier-detector tube as recited in claim 1, wherein the electrostatic potential means apply to the first mask the same electrostatic potential as is applied to the output phosphor display screen.

20. A large area, X-ray array amplifier-detector tube as recited in claim 1, wherein the scintillator-photocathode screen assembly and the output phosphor display screen are parallel to each other and are planar.

21. A large area, X-ray array amplifier-detector tube as recited in claim 1, wherein the scintillator-photocathode screen assembly and the output phosphor display screen are parallel to each other and are curved.

22. An improved, X-ray image intensifier tube of the type including:

a metallic tube envelope open at both ends, an inwardly concave metallic input window at one end of the envelope, an output phosphor display screen mounted at the other end of the envelope, scintillator-photocathode screen means for receiving an X-ray pattern image and converting it to a corresponding image of emitted electrons, electrically insulating means for suspending the scintillator-photocathode screen means within the envelope and in a plane parallel to, but spaced apart from, the output display screen, means for applying a high, electrostatic potential to the scintillator-photocathode screen means, the potential being taken with respect to the output display screen and all of the other tube elements, including the envelope, which are at a neutral potential with respect to each other, and wherein the improvement comprises at least one segmented scintillator-photocathode screen assembly and a segmented output phosphor display screen, the segmentations of the two screens being in registration with the corresponding segmentations of the other.

* * * * *